US006866019B1

(12) United States Patent
Schmitz

(10) Patent No.: US 6,866,019 B1
(45) Date of Patent: Mar. 15, 2005

(54) BREATHER-OPERATED PRIMING SYSTEM FOR SMALL INTERNAL COMBUSTION ENGINES

(75) Inventor: Phillip R. Schmitz, Malone, WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/842,995

(22) Filed: May 11, 2004

(51) Int. Cl.[7] ..... F02M 7/00
(52) U.S. Cl. ..... 123/344; 261/35
(58) Field of Search ..... 123/344, 294, 123/305, 395, 65 R; 261/35

(56) References Cited

U.S. PATENT DOCUMENTS

| | | | | |
|---|---|---|---|---|
| 2,598,147 A | | 5/1952 | Tescher | 123/139 |
| 3,805,758 A | | 4/1974 | May | 123/139 AJ |
| 4,814,114 A | | 3/1989 | Charmley | 261/35 |
| 5,503,125 A | | 4/1996 | Gund | 123/392 |
| 5,775,300 A | * | 7/1998 | Sugii | 123/438 |
| 5,803,035 A | | 9/1998 | Guntly | 123/179.11 |
| 6,012,420 A | | 1/2000 | Dykstra et al. | 123/179.18 |
| 6,135,429 A | | 10/2000 | Woody | 261/35 |
| 6,145,487 A | | 11/2000 | Dykstra et al. | 123/179.18 |
| 6,186,117 B1 | | 2/2001 | Matte | 123/437 |
| 6,523,809 B2 | | 2/2003 | Woody | 261/35 |
| 6,622,992 B2 | | 9/2003 | Woody | 261/35 |

* cited by examiner

*Primary Examiner*—Bibhu Mohanty
(74) *Attorney, Agent, or Firm*—Baker & Daniels

(57) ABSTRACT

A priming system for small internal combustion engines is operable at engine cranking speeds to prime the carburetor of the engine, and is automatically disabled at engine running speeds. The priming system includes a control valve having an air vane responsive to rotation of the engine flywheel such that, at engine cranking speeds, the air vane positions the control valve to direct pressure pulses from the crankcase breather valve to the fuel bowl of the carburetor for priming and, upon running of the engine, the air vane positions the control valve to divert the pressure pulses from the crankcase breather valve to the throat of the carburetor to recirculate the pressure pulses for combustion with the engine. The priming system also includes a temperature-responsive vent valve which is opened at warm engine temperatures to vent a substantial portion of the pressure pulses to the atmosphere to reduce the amount of priming and prevent flooding of the engine during hot re-starts of the engine.

35 Claims, 5 Drawing Sheets

BREATHER-OPERATED PRIMING SYSTEM FOR SMALL INTERNAL COMBUSTION ENGINES

BACKGROUND OF THE INVENTION

1. Field of the Invention

The present invention relates to small internal combustion engines of the type used with lawnmowers, lawn and garden tractors, snow throwers, other working implements, or small sport vehicles. In particular, the present invention relates to a priming system to aid in starting such engines.

2. Description of the Related Art

Small internal combustion engines typically include a carburetor which mixes liquid fuel with atmospheric air drawn through the carburetor to provide an air/fuel combustion mixture to the engine. One type of carburetor commonly used in small engines includes a throat with a venturi through which air is drawn, and into which fuel is also drawn for mixing with the intake air, as well as a fuel bowl disposed beneath the throat in which a quantity of liquid fuel is stored. A float valve in the fuel bowl meters a supply of fuel into the fuel bowl from a main fuel tank as necessary as the fuel in the fuel bowl is consumed.

Additionally, such carburetors typically include a manually operable priming mechanism, such as a priming bulb which is pressed by an operator to pressurize the air space above the fuel in the fuel bowl and to force a quantity of priming fuel from the fuel bowl into the carburetor throat for mixing with the intake air which is drawn into the carburetor. The priming fuel is in excess of the amount of fuel which is normally supplied for mixing with the intake air to form the combustion mixture, such that a rich air/fuel mixture is initially supplied to the engine to aid in engine starting. After the engine starts, the priming fuel is consumed, and mixing of the air/fuel mixture is thereafter controlled by the fuel metering system of the carburetor during running of the engine.

The foregoing type of priming mechanisms for carburetors requires an operator to manually press the priming bulb to prime the engine. If the operator does not press the bulb enough times, or if the operator fails to press the priming bulb altogether, pressure will not be built up within the fuel bowl of the carburetor to the extent necessary to supply priming fuel to aid in engine starting. Therefore, difficulty may be encountered in starting the engine. Conversely, if the priming bulb is pressed by an operator too many times, an undesirably large amount of priming fuel may be supplied, which could flood the engine.

Additionally, many carburetors for small engines also include a choke feature, such as a choke valve, which is manually actuated by the operator during engine starting to further enrich the air/fuel mixture initially supplied to the engine. However, until the choke feature is manually deactivated by the operator, the carburetor will continue to supply an enriched air/fuel mixture to the engine after the engine has started, which could flood the engine. Therefore, the operator must remember to deactivate the choke feature after the engine begins to run in order to prevent the engine from flooding.

In small internal combustion engines, the reciprocation of the piston within the engine cylinder at cranking and running speeds of the engine creates positive and negative pressure fluctuations, or positive and negative pressure pulses, within the crankcase of the engine. Additionally, when the piston reciprocates within the cylinder, a small portion of the gases within the combustion chamber of the engine may pass between the piston and the cylinder bore, particularly during the compression stroke of the piston. Therefore, during running of the engine, although there are both positive and negative pressure pulses in the engine crankcase, the average pressure within the crankcase is positive. A portion of the positive pressure within the crankcase must be vented during running of the engine, typically through a one-way breather check valve in the engine crankcase. Positive pressure pulses from the breather valve are typically "recirculated" to the intake system of the engine, for mixing with the intake air and fuel for combustion within the engine.

It is desirable to provide a priming system for use in small internal combustion engines having carburetors which is an improvement over the foregoing.

SUMMARY OF THE INVENTION

The present invention provides a priming system for small internal combustion engines. The priming system is operable at engine cranking speeds to prime the carburetor of the engine, and is automatically disabled at engine running speeds. The priming system includes a control valve having an air vane responsive to rotation of the engine flywheel such that, at engine cranking speeds, the air vane positions the control valve to direct pressure pulses from the crankcase breather valve to the fuel bowl of the carburetor for priming and, upon running of the engine, the air vane positions the control valve to divert the pressure pulses from the crankcase breather valve to the throat of the carburetor to recirculate the pressure pulses for combustion with the engine. The priming system also includes a temperature-responsive vent valve which is opened at warm engine temperatures to vent a substantial portion of the pressure pulses to the atmosphere to reduce the amount of priming and prevent flooding of the engine during hot re-starts of the engine.

During cold engine starts, cranking of the engine rotates the flywheel to generate an airflow which is insufficient to move the air vane against the bias of a return spring, and the control valve is positioned in a first position in which pressure pulses from the crankcase breather valve are directed through the control valve to the carburetor. The pressure pulses actuate a primer valve within the carburetor to open airflow to the fuel bowl of the carburetor and concurrently seal the internal vent of the carburetor, such that the fuel bowl of the carburetor is pressurized and an amount of liquid priming fuel is supplied to the throat of the carburetor. When the engine is cold, the vent valve is closed, such that flow of the pressure pulses to the fuel bowl of the carburetor, and the resulting priming, is maximized.

After the engine starts, the rotation of the flywheel increases, and increased airflow from the flywheel moves the air vane and control valve against the bias of the return spring toward a second position in which the control valve blocks the flow of pressure pulses to the fuel bowl of the carburetor and diverts same to the throat of the carburetor for combustion within the engine. However, as the air vane moves, a portion of the pressure pulses may still pass through the control valve to the fuel bowl of the carburetor to continue the pressurization of the fuel bowl and thereby provide an enriched fuel/air combustion mixture to the engine as the engine reaches running speed. As the engine reaches running speed, the air vane and control valve are moved to the second position to block the flow of pressure pulses to the fuel bowl of the carburetor such that the priming operation is terminated, and the primer valve in the carburetor opens the internal vent within the carburetor.

After the engine runs and becomes heated, a bimetallic element of the vent valve opens the conduit communicating the control valve and the fuel bowl of the carburetor to the atmosphere. Then, during hot engine re-starts, a significant portion of the pressure pulses from the crankcase breather valve are vented through the vent valve to the atmosphere while a reduced portion of the pressure pulses pass into the carburetor fuel bowl for priming. In this manner, the amount of priming fuel supplied to the throat of the carburetor is reduced during hot engine re-starts to prevent flooding of the engine.

Advantageously, because the present priming system uses pressure pulses from the engine crankcase for priming, as controlled by the control valve and vent valve, the priming system does not require manual priming of the carburetor or manual operation of any of the features of the priming system. Thus, the priming system is fully automatic, and is operable to prime the engine and to provide enrichment fuel to the engine in cold starts, and to provide a reduced amount of priming in hot engine re-starts, without the need for operator intervention or control.

In one form thereof, the present invention provides an internal combustion engine, including a crankcase; a crankshaft, connecting rod, and piston assembly disposed within the crankcase, the piston reciprocable to generate pressure pulses within the crankcase at cranking and running speeds of the engine; a carburetor including an internal chamber; and a priming system, including an engine-responsive control valve in fluid communication with the crankcase and the carburetor internal chamber, the control valve positioned at engine cranking speeds to direct a substantial portion of the pressure pulses to the carburetor internal chamber and positioned at engine running speeds to divert a substantial portion of the pressure pulses away from the carburetor internal chamber.

In another form thereof, the present invention provides an internal combustion engine, including a crankcase; a crankshaft, connecting rod, and piston assembly disposed within the crankcase, the piston reciprocable to generate pressure pulses within the crankcase at cranking and running speeds of the engine; a flywheel drivably coupled to the crankshaft; a carburetor including a fuel bowl; and a priming system, including a control valve in fluid communication with the crankcase and the fuel bowl, the control valve including an air vane movable responsive to rotation of the flywheel, the air vane positioning the control valve at engine cranking speeds to direct at least a portion of the pressure pulses to the fuel bowl, and positioning the control valve at engine running speeds to divert at least a portion of the pressure pulses away from the fuel bowl.

In a further form thereof, the present invention provides an internal combustion engine, including a crankcase; a crankshaft, connecting rod, and piston assembly disposed within the crankcase, the piston reciprocable to generate pressure pulses within the crankcase at cranking and running speeds of the engine; a carburetor including a fuel bowl; and a priming system, including a control valve in fluid communication with the crankcase and the fuel bowl, the control valve movable responsive to cranking and running speeds of the engine, the control valve positioned in a first position at engine cranking speeds in which the control valve directs a substantial portion of the pressure pulses to the fuel bowl, and positioned in a second position at engine running speeds in which the control valve diverts a substantial portion of the pressure pulses away from the fuel bowl; and a vent valve in fluid communication with the control valve and the fuel bowl, the vent valve movable between a closed position at cold engine temperatures and an open position at warm engine temperatures, whereby in the closed position, a substantial portion of the pressure pulses pass from the control valve to the fuel bowl and in the open position, a substantial portion of the pressure pulses are vented to the atmosphere.

In a further form thereof, the present invention provides an internal combustion engine, including a crankcase; a crankshaft, connecting rod, and piston assembly disposed within the crankcase, the piston reciprocable to generate pressure pulses within the crankcase at cranking and running speeds of the engine; a carburetor including a fuel bowl; and a priming system, including engine-responsive means for directing a substantial portion of the pressure pulses to the fuel bowl at engine cranking speeds and for diverting a substantial portion of the pressure pulses away from the fuel bowl at engine running speeds; and temperature-responsive means for substantially disabling the priming system at warm engine temperatures.

In a still further form thereof, the present invention provides a method of operating an internal combustion engine, including the steps of starting the engine by cranking a crankshaft, connecting rod, and piston assembly to thereby generate pressure pulses within a crankcase of the engine; priming a carburetor of the engine by directing at least a portion of the pressure pulses to an internal chamber of the carburetor, automatically diverting at least a portion of the pressure pulses away from the internal chamber of the carburetor after the engine is started; and substantially disabling priming of the carburetor during subsequent re-starts of the engine.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention any manner.

DETAILED DESCRIPTION

Figure 1:
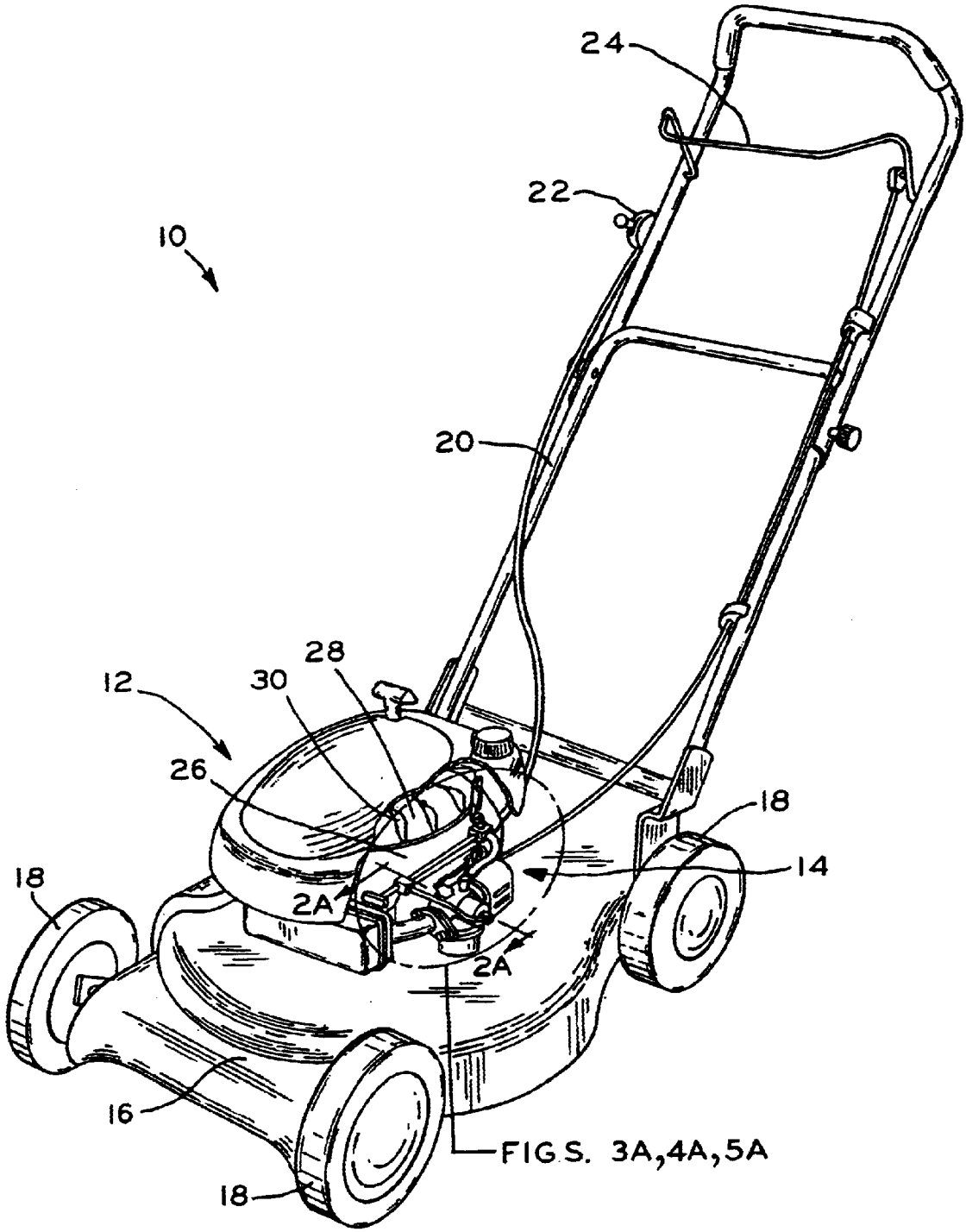
FIG. 1 is a perspective view of a lawnmower, shown as an exemplary implement including an engine having a priming system in accordance with the present invention.

Referring to FIG. 1, lawnmower 10 is shown as an exemplary implement including an engine 12 having a priming system 14 according to the present invention. Lawnmower 10 generally includes deck 16 to which engine 12 is mounted, wheels 18 mounted to deck 16, and handle 20 extending upwardly from deck 16 and including suitable controls for the operation of engine 12, such as throttle/speed control 22, and bail assembly 24 connected to an engine brake (not shown).

Engine 12 is shown and described herein as a small, single-cylinder vertical crankshaft engine, generally including crankcase 26 in which is rotatably disposed a crankshaft (not shown). The crankshaft includes flywheel 28 connected to the upper end thereof which extends externally of crankcase 26, and the opposite end of the crankshaft is drivably connected to a blade disposed beneath deck 16 for cutting grass. Flywheel 28 includes a plurality of fins 30 for generating a flow of cooling air across engine 12 upon rotation of flywheel 28. Engine 12 additionally includes a piston and connecting rod (not shown) connected to the crankshaft in a known manner, the piston reciprocal within a cylinder bore (not shown) of engine 12.

Engine 12 may be any of a number of small internal combustion engines manufactured by Tecumseh Products Company of Grafton, Wis., or any of the engines which are disclosed in U.S. Pat. Nos. 6,032,655; 6,276,324; 6,279,522; 6,295,959; 6,499,453; and U.S. Pat. No. 6,612,275, each assigned to the assignee of the present invention, the disclosures of which are expressly incorporated herein by reference. Although priming system 14 is shown herein and described below in connection with a single cylinder, vertical crankshaft engine, priming system 14 may also be used with other engines having horizontal crankshafts, for example, or with engines including two or more cylinders.

During cranking and running speeds of engine 12, the piston is reciprocal within the engine cylinder bore between its top dead center ("TDC") and bottom dead center ("BDC") positions to generate positive and negative pressure fluctuations, or pressure pulses, within crankcase 26. Additionally, a small amount of the gases within the combustion chamber of engine 12 may pass between the piston and the cylinder bore and into crankcase 26 at cranking and running speeds of engine 12, particularly during the compression stroke of the piston. These gases, known as "blow-by" gases, accumulate within crankcase 26 and must be vented therefrom. Typically, crankcase 26 includes a one-way breather check valve, such as breather valve 32 (FIG. 3A), to vent positive pressure pulses from crankcase 26. Typically, the positive pressure pulses are communicated from the breather valve 32 to the intake system of engine 12 for recirculation, in which the positive pressure pulses are combined with the intake air and fuel of engine 12 for combustion within engine 12. As used herein the term "positive pressure pulses" means pressure pulses having a pressure which is greater than atmospheric pressure.

Figure 2A:
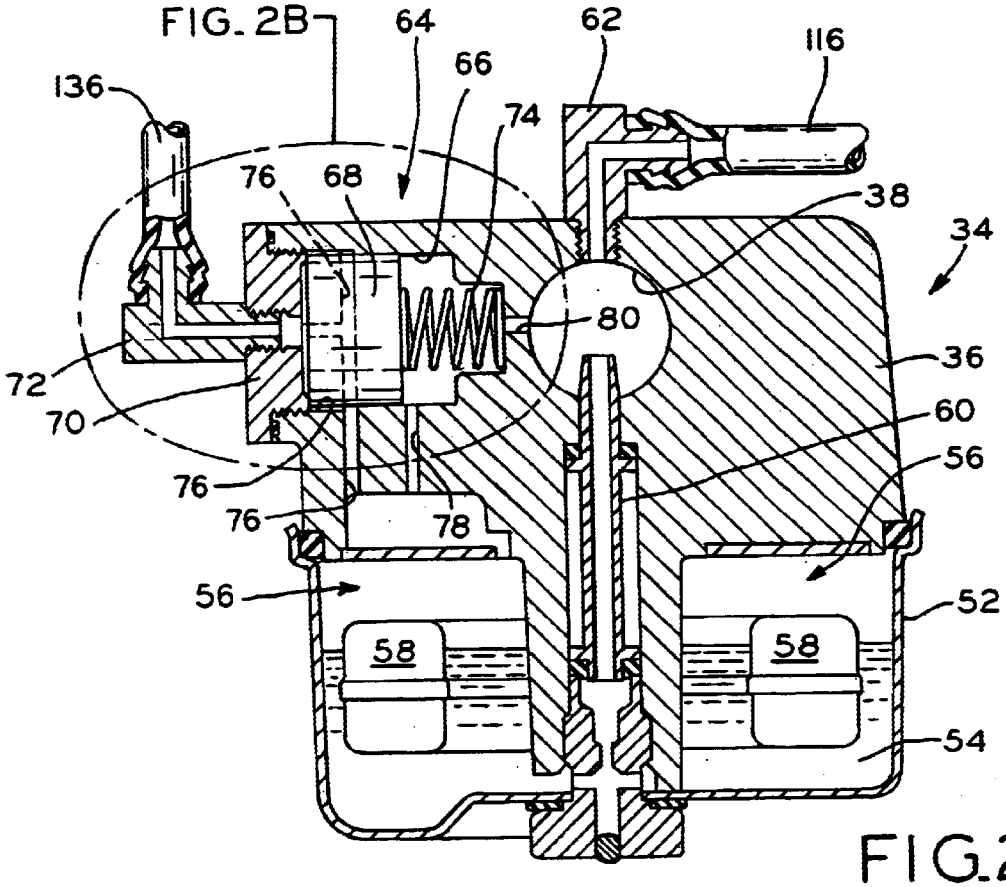
FIG. 2A is a sectional view through the carburetor of the engine, taken along line 2A—2A of FIG. 1, showing the primer valve of the carburetor in a closed position.
Figure 3B:
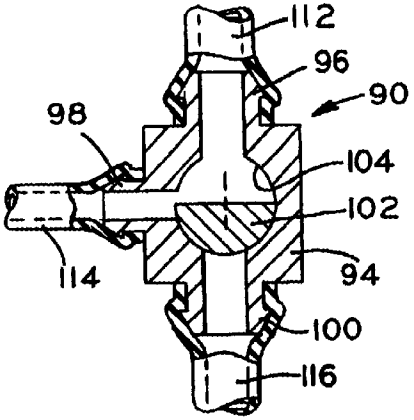
FIG. 3B is a sectional view through the control valve, taken along line 3B—3B of FIG. 3A.
Figure 3C:
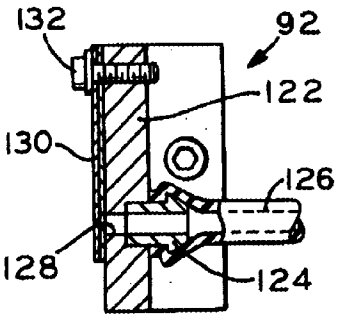
FIG. 3C is a sectional view through the vent valve, taken along line 3C—3C of FIG. 3A.
Figure 3A:
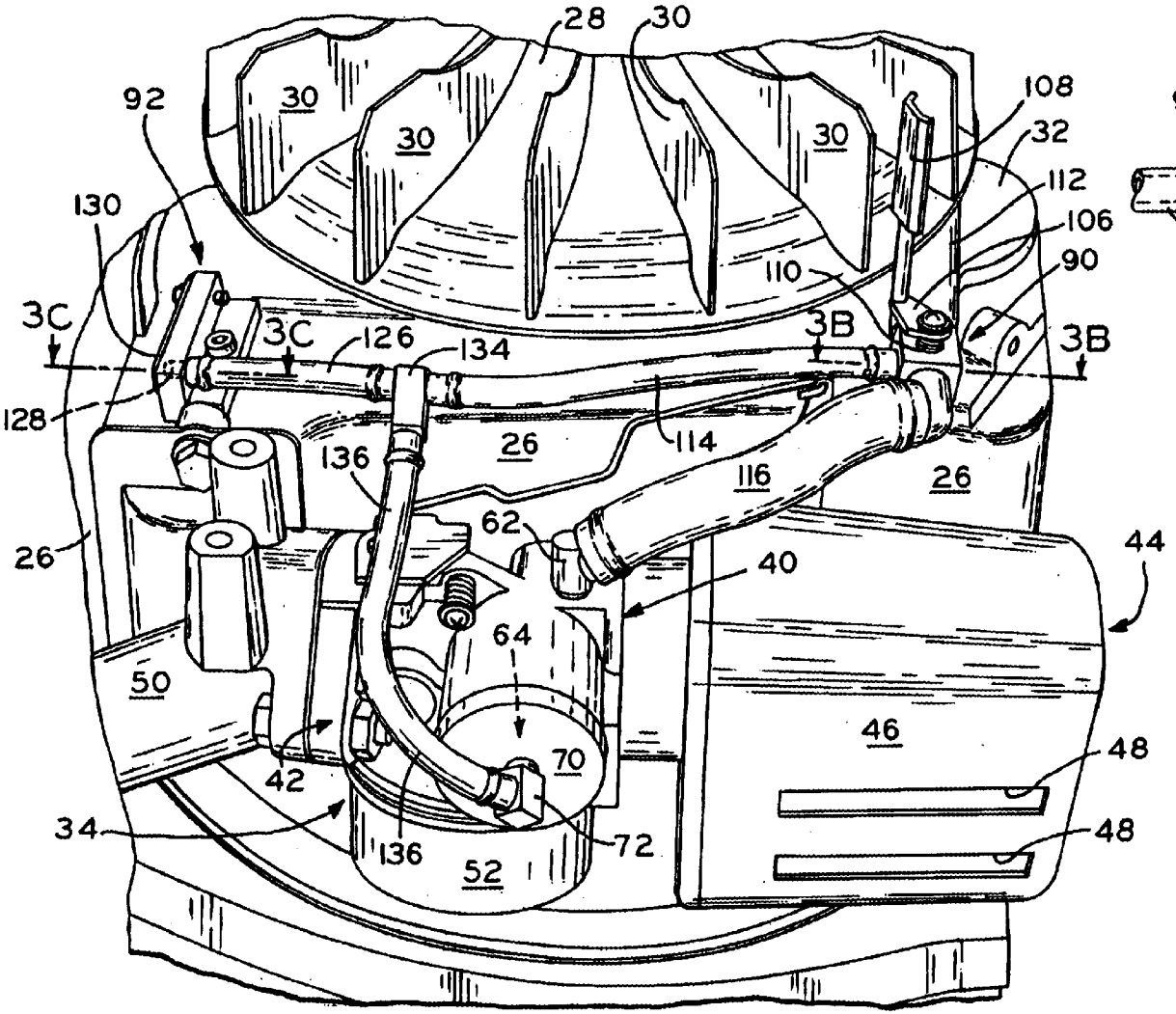
FIG. 3A is a fragmentary perspective view of a portion of the engine of FIG. 1, showing the carburetor and features of the present priming system during a cold start of the engine.

Referring to FIGS. 2A and 3A, carburetor 34 generally includes carburetor body 36 having an air/fuel passageway including throat 38 disposed therethrough from inlet end 40 to outlet end 42 of carburetor 34. Carburetor 34 includes many features which are generally similar to the carburetor disclosed in U.S. Pat. No. 6,152,431, assigned to the assignee of the present invention, the disclosure of which is expressly incorporated herein by reference. Air filter 44 is connected to inlet end 40 of carburetor 34, and includes filter body 46 having inlet slots 48 for the passage of intake air into filter body 46 and through a filter element (not shown) disposed within filter body 46, whereby dirt, dust, and other debris are removed from the intake air. Outlet end 44 of carburetor 34 is attached to inlet manifold 50 of engine 12.

Carburetor 34 includes an internal chamber, shown herein as fuel bowl 52 attached to the lower portion of carburetor body 36, which contains a quantity of liquid fuel 54 and air space 56 above the liquid fuel 54. A fuel valve assembly (not shown) includes float 58, and is operable to meter fuel into fuel bowl 52 from the fuel tank (not shown) of engine 12 as necessary to maintain a relatively constant level of fuel 54 within fuel bowl 52. Main fuel jet 60 extends upwardly from fuel bowl 52 into throat 38 of carburetor 34 proximate a venturi region (not shown) within throat 38 and, during operation of engine 12, the passage of air through throat 38 of carburetor 34 creates a low pressure region at the venturi within throat 38 to draw fuel 54 upwardly through main fuel jet 60 into throat 38 of carburetor 34 for mixing with intake air to provide a fuel/air combustion mixture for supply to engine 12. Carburetor 34 additionally includes breather fitting 62 in fluid communication with throat 38, through which pressure pulses from breather valve 32 of crankcase 26 are communicated to throat 38 of carburetor 34 at running speeds of engine 12, as described below.

Figure 2B:
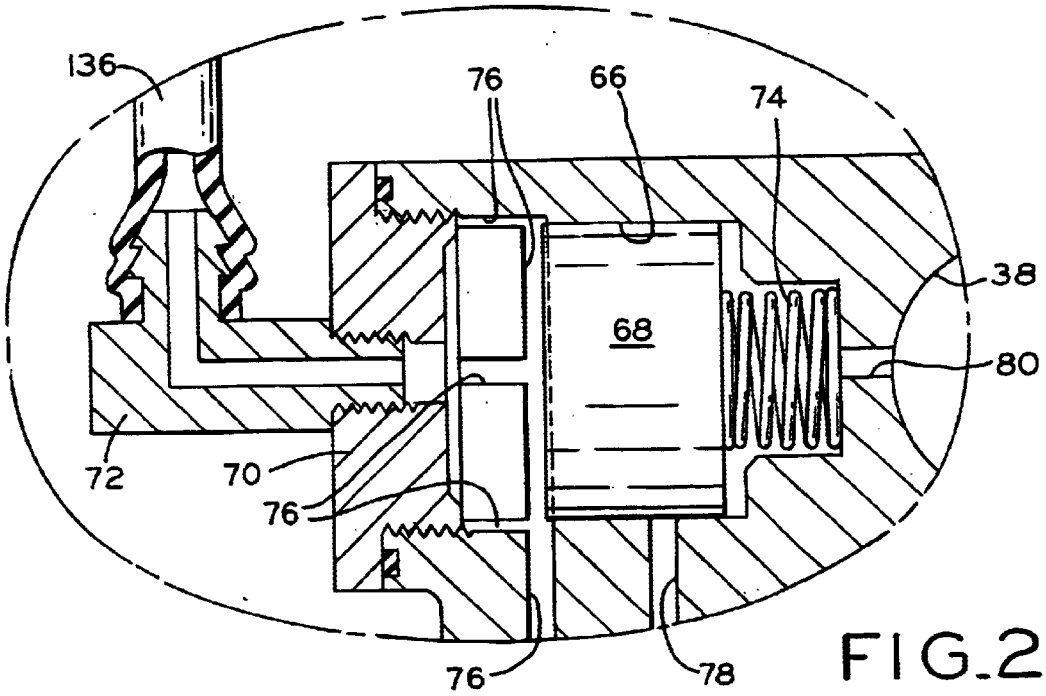
FIG. 2B is a fragmentary view a portion of FIG. 2B, showing the primer valve of the carburetor in an open position.

Referring to FIGS. 2A and 2B, carburetor 34 additionally includes primer valve assembly 64. Primer valve member 68 is slidably disposed within bore 66 in carburetor body 36 in close fitting engagement therewith. Cap 70 includes fitting 72, as well as external threads in engagement with internal threads of bore 66 to close the end of bore 66. Spring 74 is captured between valve member 68 and the blind end of bore 66, and normally biases valve member 68 to a first or closed position in which valve member 68 is in abutment with cap 70. Bore 66 includes a plurality of vent passages 76 therearound which are in communication with air space 56 of fuel bowl 52 and are normally blocked by valve member 68 when valve member 68 is its first or closed position. Internal vent passage 78 of carburetor 34 extends between air space 56 of fuel bowl 52 and bore 66, and internal vent port 80 fluidly communicates bore 66 with throat 38 of carburetor 34 such that, at running speeds of engine 12 in which valve member 68 is disposed in its closed position, air space 56 of fuel bowl 52 is in fluid communication with throat 38 and air space 56 is at sub-atmospheric pressure.

Valve member 68 is movable between a first or closed position, shown in FIG. 2A, and a second or open position, shown in FIG. 2B. In the closed position shown in FIG. 2A, spring 74 biases valve member 68 into abutment with cap 70 wherein valve member 68 blocks vent passages 76 from fluidly communication with fitting 72 of cap 70, and internal vent passage 78 is in fluid communication with bore 66, which in turn is in fluid communication with throat 38 via internal vent port 80. In the open position shown in FIG. 2B, valve member 68 is displaced against spring 74 and out of abutment with cap 70 to allow fluid communication from fitting 72 of cap 70 through vent passages 76 to air space 56 of fuel bowl, and valve member 68 concurrently blocks internal vent passage 78 to block air space 56 of fuel bowl 52 from fluid communication with bore 66 and throat 38.

Referring to FIG. 3A, priming system 14 generally includes control valve 90 in fluid communication with breather valve 32 of crankcase 26, vent valve 92, and a number of conduits 112, 114, 116, 126, and 136 fluidly connecting the foregoing components to one another and to carburetor 34 in the manner described below.

Figure 4B:
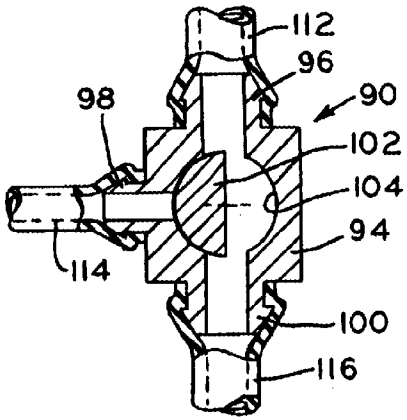
FIG. 4B is a sectional view through the control valve, taken along line 4B—4B of FIG. 4A.

Referring to FIGS. 3A and 3B, control valve 90 generally includes valve body 94 having first, second and third fittings 96, 98, and 100. Valve member 102 is rotatably disposed within circular bore 104 in valve body 94, and is hemispherically shaped as shown in FIG. 3B. Valve member 102 extends externally of valve body 94, and includes valve lever 106 connected to air vane 108. Air vane 108 is disposed closely proximate flywheel 28. Coil spring 110 is disposed about valve member 102, and normally biases air vane 108 and valve member 102 together to a first position, shown in FIGS. 3A and 3B, in which air vane 108 is disposed closely proximate fins 30 of flywheel 28, and fitting 96 of valve body 94 is in fluid communication with fitting 98. Upon rapid rotation of flywheel 28 at running speeds of engine 12, as shown in FIGS. 4A and 4B, the strong airflow generated by fins 30 of flywheel 28 contacts air vane 108 and moves air vane 108 outwardly of flywheel 28 against the bias of spring 110 to a second position, shown in FIGS. 4A and 4B, concurrently rotating valve member 102 within bore 104 of valve body 94 such that fitting 96 of valve body 94 is in communication with fitting 100.

As shown in FIGS. 3A and 3B, conduit 112 is connected to first fitting 96 for fluidly communicating breather valve 32 of crankcase 26 with control valve 90. Conduit 114 is connected to second fitting 98, and conduit 116 is connected to third fitting 100 and at its opposite end to breather fitting 62 of carburetor 34.

Referring to FIGS. 3A and 3C, vent valve 92 generally includes valve plate 122 attached to crankcase 26, with valve plate 122 having fitting 124 for connecting to vent conduit 126. Valve plate 122 also includes vent opening 128 therethrough. Bimetallic element 130, shown herein as a bimetallic metal strip, is fixedly mounted to valve plate 122 by fastener 132, and covers vent opening 128. When engine 12 and bimetallic element 130 are cold, bimetallic element 130 is disposed in a first or cold position, shown in FIG. 3C, in which bimetallic element 130 covers vent opening 128 to close vent valve 92. After engine 12 starts and gradually becomes heated, heat is conducted from crankcase 26 through valve plate 122 to bimetallic element 130, and bimetallic element 130 moves to a second or open position, shown in FIG. 5C, in which bimetallic element 130 flexes away from vent opening 128 to open vent valve 92, wherein vent opening 128 and vent conduit 126 are placed in fluid communication with the atmosphere.

Referring to FIG. 3A, T-fitting 134 connects conduit 114, vent conduit 126, and conduit 136 to one another, and the end of conduit 136 opposite T-fitting 134 is connected to fitting 72 of carburetor 34 in fluid communication with primer valve assembly 64 of carburetor 34, as shown in FIG. 2A and discussed above.

Priming system 14 operates as follows. Referring to FIGS. 3A–3C, when engine 12 is cold, spring 110 biases air vane 108 and valve member 102 of control valve 90 to the first position shown in FIG. 3B to place breather valve 32 of crankcase 26 in fluid communication with primer valve assembly 64 of carburetor 34 through conduits 112, 114, T-fitting 134, and conduit 136, and to block fluid communication between breather valve 32 to breather fitting 62 of carburetor 34 through conduit 116. Additionally, bimetallic element 130 of vent valve 92 is disposed in its closed position, shown in FIG. 3C, such that vent opening 128 of vent valve 92 is closed. When engine 12 is cranked for starting, such as by a manually-operated recoil starter or an electric starter (not shown), reciprocation of the piston within the cylinder bore in engine 12 creates positive and negative pressure fluctuations in crankcase 26, with positive pressure pulses passing through breather valve 32 and control valve 90 to primer valve assembly 64 of carburetor 34. During cranking of engine 12, the rotation of the crankshaft and flywheel 28 is relatively slow, and the airflow from fins 30 of flywheel 28 is insufficient to bias air vane 108 against the bias of spring 110 to its second position.

Referring to FIGS. 2A and 2B, the positive pressure pulses directed to primer valve assembly 64 of carburetor 34 by control valve 90 bias valve member 68 against spring 74 away from cap 70, thereby permitting the positive pressure pulses to enter priming passages 76 and air space 56 of carburetor 34. Concurrently, movement of valve member 68 against spring 74 blocks internal vent passage 78 to effectively seal air space 56, such that the positive pressure pulses accumulate within air space 56 to pressurize air space 56. Pressurization of air space 56 forces an amount of liquid fuel 54 from fuel bowl 52 of carburetor 34 upwardly through main fuel jet 60 and into throat 38 of carburetor 34 for priming. Valve member 68 may be biased against spring 74 to move valve member 68 a relatively large extent against the bias of spring 74 as shown in FIG. 2B, or alternatively, if the positive pressure pulses are insufficient to move valve member 68 completely to the position shown in FIG. 2B, same may still move valve member 68 to a lesser extent, permitting fluid communication of the positive pressure pulses through priming passages 76 and into air space 56 of fuel bowl 52.

Referring to FIG. 4A, after engine 12 starts, the crankshaft and flywheel 28 begin to rotate very rapidly, such that fins 30 of flywheel 28 generate a much stronger airflow against air vane 108. The stronger air flow against air vane 108 is sufficient to overcome the bias of coil spring 110, rotating air vane 108 and valve member 102 toward their second position, shown in FIG. 4B. As the crankshaft and flywheel 28 of engine 12 accelerate, air vane and valve member 102 rotate to their second position as described above; however, before valve member 102 rotates completely to its second position shown in FIG. 4B, positive pressure pulses from breather valve 32 of crankcase 26 may still pass through control valve 90 to fuel bowl 52 of carburetor 34 as described above, resulting in the supply of an amount of enrichment fuel to throat 38 of carburetor to provide an enriched air/fuel combustion mixture to engine 12 to aid engine 12 in reaching its full running speed.

When air vane 108 and valve member 102 are disposed in their second position at engine running speeds, as shown in FIG. 4B, fitting 98 of control valve 90 and conduit 114 are blocked to prevent pressure pulses from being directed to carburetor 34 in the manner described above and thereby terminating the priming operation. Rather, positive pressure pulses from breather valve 32 of crankcase 26 are communicated through conduit 112, control valve 90, and conduit 116 to breather fitting 62 of carburetor 34, such that the positive pressure pulses are directed into the throat 38 of carburetor 34 to combine with intake air and fuel for consumption within engine 12.

Figure 4C:
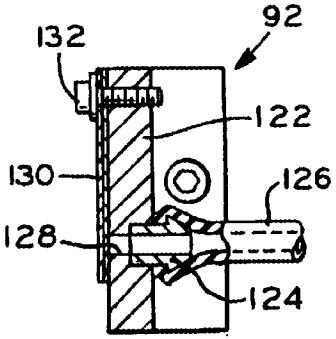
FIG. 4C is a sectional view through the vent valve, taken along line 4C—4C of FIG. 4A.
Figure 4A:
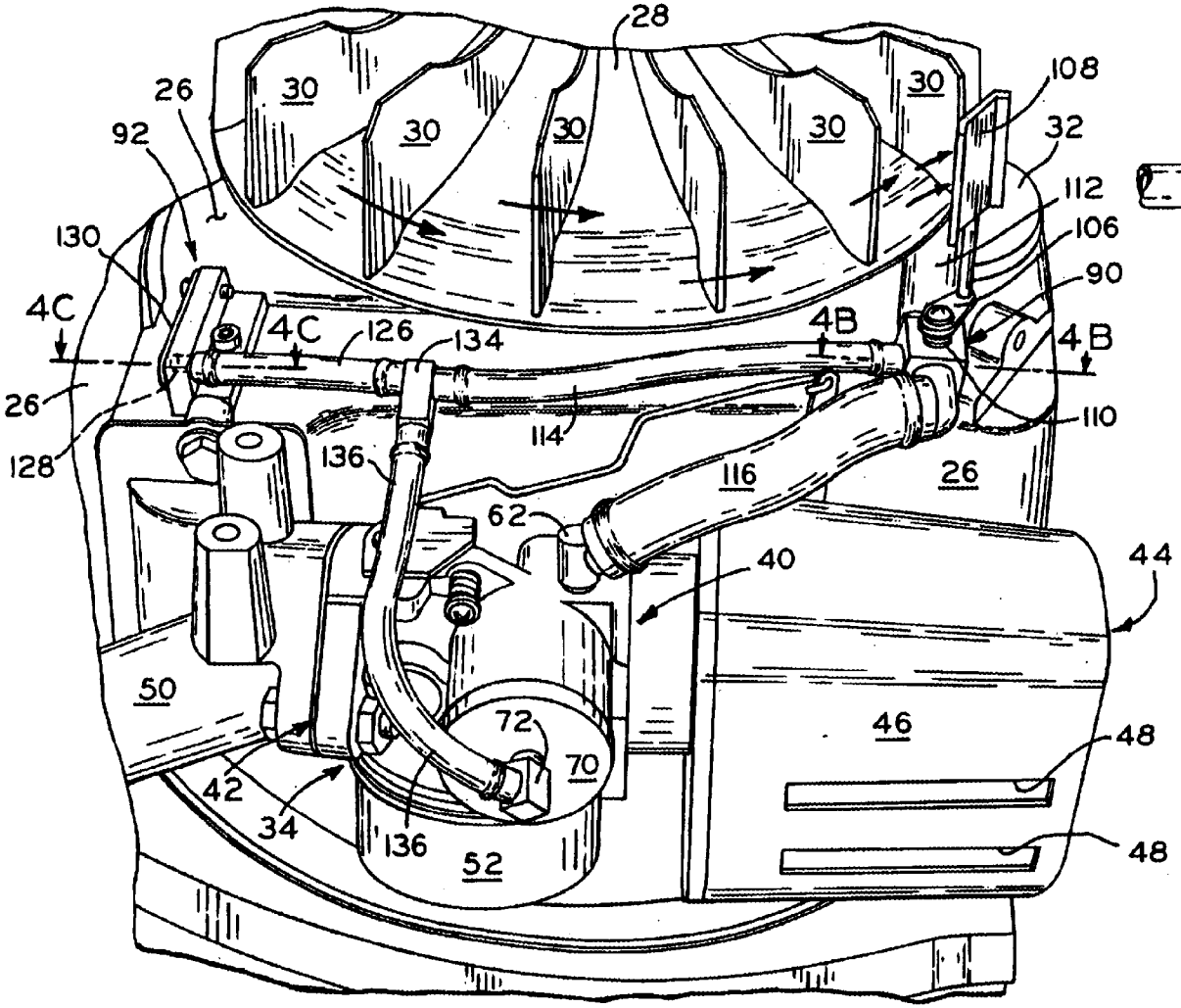
FIG. 4A is a fragmentary perspective view of a portion of the engine of FIG. 1, showing the carburetor and features of the present priming system during running of the engine.
Figure 5B:
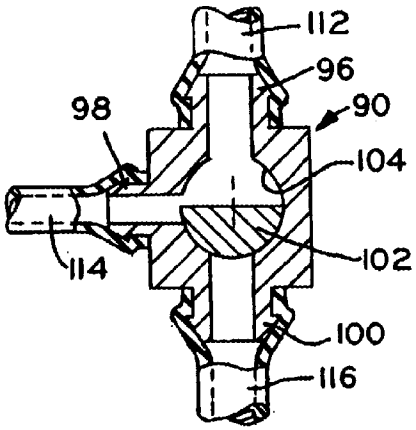
FIG. 5B is a sectional view through the control valve, taken along line 5B—5B of FIG. 5A.
Figure 5C:
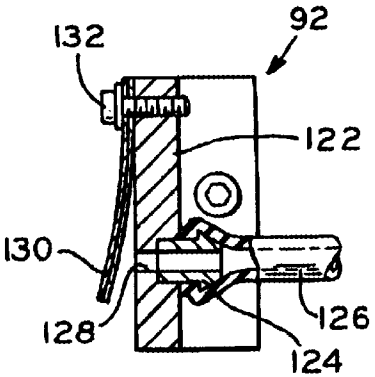
FIG. 5C is a sectional view through the vent valve, taken along line 5C—5C of FIG. 5A.
Figure 5A:
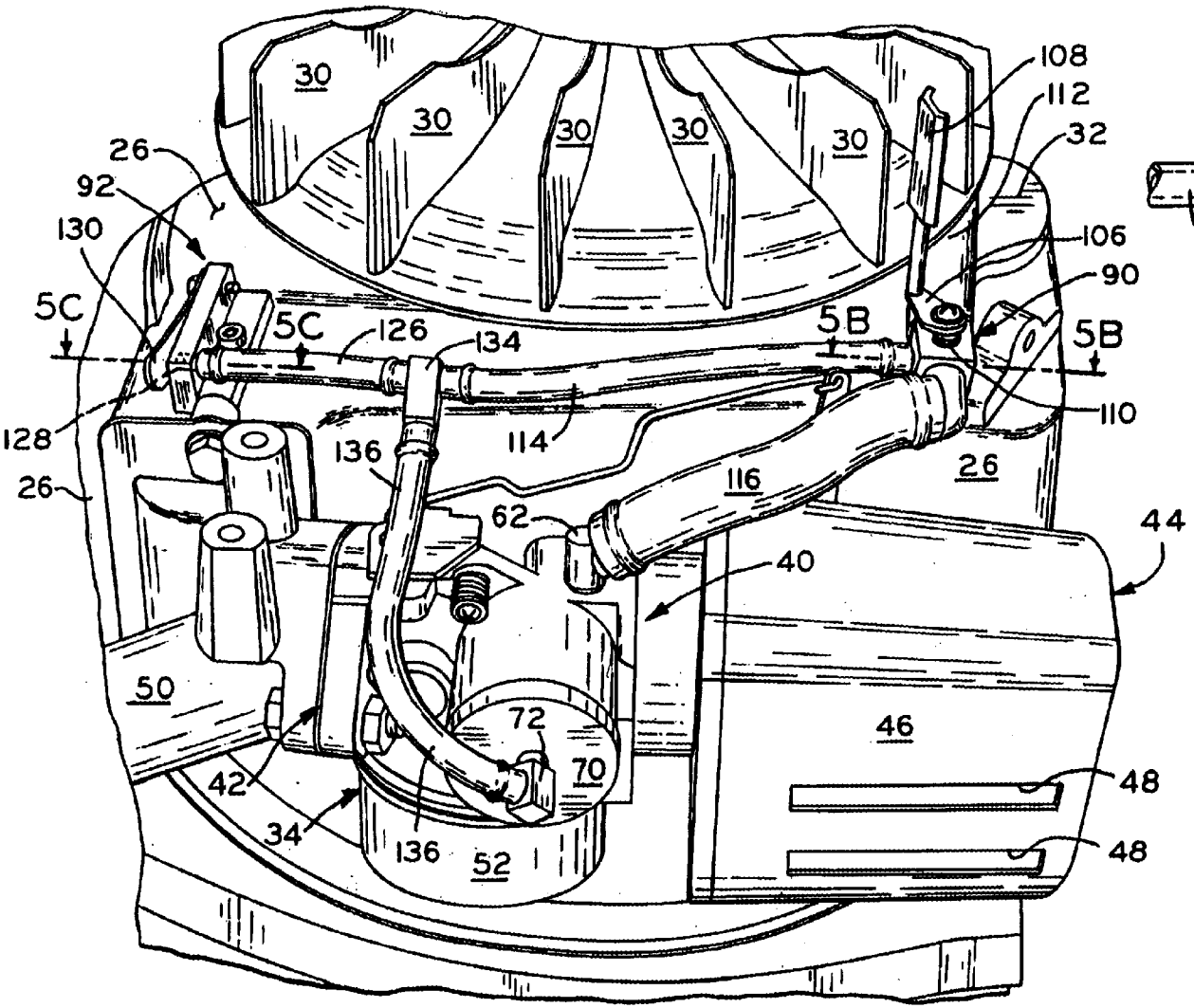
FIG. 5A is a fragmentary perspective view of a portion of the engine of FIG. 1, showing the carburetor and features of the present priming system during a hot re-start of the engine.

When engine 12 first reaches its running speed, engine 12 is still relatively cold, and vent valve 92 remains in its closed position, shown in FIG. 4C. However, after engine 12 is run a sufficient amount of time and becomes heated, heat from engine 12 is transferred by conduction from crankcase 26 to valve plate 122 of vent valve 92, thereby heating bimetallic element 130 such that bimetallic element 130 bends away from vent opening 128 of vent valve 92 to its open position, as shown in FIG. 5C. When vent valve 92 is in its open position, if engine 12 is shut down and is then restarted while hot, positive pressure pulses from breather valve 32 of crankcase 26 are directed through control valve 90 as described above upon cranking of engine 12, however, a substantial portion, i.e., a majority, of the positive pressure pulses are vented to the atmosphere through vent valve 92 rather than being communicated to primer valve assembly 64 of carburetor 34 as described above. However, a reduced portion of the positive pressure pulses may still pass to primer valve assembly 64 of carburetor 34, opening valve member 68 and resulting in slight pressurization of air space 56 above the fuel 54 within fuel bowl 52 of carburetor 34, thereby resulting in supply of a small amount of priming fuel to throat 38 of carburetor 34 for priming during a hot re-start of engine 12.

Advantageously, the present priming system 14 is fully automatic, and does not require any intervention of the operator of the implement with which engine 12 is used to prime carburetor 34 for starting engine 12. Specifically, air vane 108 and control valve 90 are automatically responsive to the rotation of flywheel 28 and therefore to the speed of engine 12 to direct positive pressure pulses from breather valve 32 of crankcase 26 to carburetor 34 during engine cranking for priming, and after engine start-up, to divert the positive pressure pulses from breather valve 32 of crankcase 26 to throat 38 of carburetor 34 for consumption within engine 12. Additionally, vent valve 92 is automatically operable to move between a closed position when engine 12 is cold, shown in FIGS. 3C and 4C, in which vent valve 92 is closed to enable maximum priming of carburetor 34, and an open position when engine 12 is warm, shown in FIG. 5C, in which vent valve 92 is opened to vent positive pressure pulses from breather valve 32 of crankcase 26 to the atmosphere and thereby reduce the amount of priming of carburetor 34 during hot re-starts of engine 12.

Although priming system 14 is described herein with respect to carburetor 34, which is shown as a fuel bowl-type carburetor, priming system 14 may also be used with diaphragm-type carburetors. In particular, for use with a diaphragm-type carburetor, control valve 90 may be used to control the supply of positive pressure pulses from breather valve 32 of crankcase 26 to one side of a fuel chamber diaphragm to thereby force an excess amount of liquid fuel from the fuel chamber into the throat of the carburetor for priming. Also, control valve 90 may be used to control the supply of positive pressure pulses from breather valve 32 of crankcase 26 to an auxiliary fuel priming pump which supplies an excess amount of fuel to the throat of the carburetor for priming.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine, comprising:

a crankcase;

a crankshaft, connecting rod, and piston assembly disposed within said crankcase, said piston reciprocable to generate pressure pulses within said crankcase at cranking and running speeds of said engine;

a carburetor including an internal chamber; and a priming system, comprising:

an engine-responsive control valve in fluid communication with said crankcase and said carburetor internal chamber, said control valve positioned at engine cranking speeds to direct a substantial portion of the pressure pulses to said carburetor internal chamber and positioned at engine running speeds to divert a substantial portion of the pressure pulses away from said carburetor internal chamber.

2. The internal combustion engine of claim 1, wherein said internal chamber of said carburetor is a fuel bowl containing liquid fuel and an air space disposed above the liquid fuel.

3. The internal combustion engine of claim 1, wherein said crankcase further comprises a one-way breather valve, said breather valve venting only positive pressure pulses from said crankcase.

4. The internal combustion engine of claim 1, wherein said carburetor further comprises a fuel/air passage, said control valve positioned at engine running speeds to divert a substantial portion of the pressure pulses to said fuel/air passage.

5. The internal combustion engine of claim 1, further comprising a flywheel disposed externally of said crankcase, said flywheel drivably coupled to said crankshaft.

6. The internal combustion engine of claim 5, wherein said control valve comprises an air vane movable responsive to rotation of said flywheel, said air vane positioning said control valve at engine cranking and running speeds.

7. The internal combustion engine of claim 1, wherein said priming system further comprises a vent valve in fluid communication with said control valve and said carburetor, said vent valve positioned in a closed position at cold engine temperatures, whereby a substantial portion of the pressure pulses pass from said control valve to said carburetor, and positioned in an open position at warm temperatures, whereby a substantial portion of the pressure pulses are vented to the atmosphere.

8. The internal combustion engine of claim 7, wherein said vent valve comprises a temperature-responsive bimetallic element.

9. The internal combustion engine of claim 1, wherein said carburetor further comprises a primer valve in fluid communication with said control valve and with said carburetor internal chamber and movable responsive to the pressure pulses, said primer valve positioned at engine cranking speeds to allow the pressure pulses to enter said carburetor internal chamber and positioned at engine running speeds to substantially block entry of the pressure pulses into said carburetor internal chamber.

10. The internal combustion engine of claim 9, wherein said carburetor further comprises an internal vent, said primer valve positioned at engine cranking speeds to substantially block said internal vent and positioned at engine running speeds to open said internal vent.

11. An internal combustion engine, comprising:

a crankcase;

a crankshaft, connecting rod, and piston assembly disposed within said crankcase, said piston reciprocable to generate pressure pulses within said crankcase at cranking and running speeds of said engine;

a flywheel drivably coupled to said crankshaft;

a carburetor including a fuel bowl; and a priming system, comprising:

a control valve in fluid communication with said crankcase and said fuel bowl, said control valve including an air vane movable responsive to rotation of said flywheel, said air vane positioning said control valve at engine cranking speeds to direct at least a portion of the pressure pulses to said fuel bowl, and positioning said control valve at engine running speeds to divert at least a portion of the pressure pulses away from said fuel bowl.

12. The internal combustion engine of claim 11, wherein said crankcase further comprises a one-way breather valve venting only positive pressure pulses from said crankcase.

13. The internal combustion engine of claim 11, wherein said carburetor further comprises a fuel/air passage, said control valve positioned at engine running speeds to divert a substantial portion of the pressure pulses to said fuel/air passage.

14. The internal combustion engine of claim 11, wherein said priming system further comprises an engine temperature-responsive vent valve in fluid communication with said control valve and said fuel bowl, said vent valve positioned in a closed position at cold engine temperatures, whereby a substantial portion of the pressure pulses pass from said control valve to said fuel bowl, and positioned in an open position at warm temperatures, whereby a substantial portion of the pressure pulses are vented to the atmosphere.

15. The internal combustion engine of claim 14, wherein said vent valve comprises a bimetallic element.

16. The internal combustion engine of claim 11, wherein said carburetor further comprises a primer valve in fluid communication with said control valve and with said carburetor internal chamber and movable responsive to the pressure pulses, said primer valve positioned at engine cranking speeds to allow the pressure pulses to enter said carburetor internal chamber and positioned at engine running speeds to substantially block entry of the pressure pulses into said carburetor internal chamber.

17. The internal combustion engine of claim 16, wherein said carburetor further comprises an internal vent, said primer valve positioned at engine cranking speeds to substantially block said internal vent and positioned at engine running speeds to open said internal vent.

18. An internal combustion engine, comprising:

a crankcase;

a crankshaft, connecting rod, and piston assembly disposed within said crankcase, said piston reciprocable to generate pressure pulses within said crankcase at cranking and running speeds of said engine;

a carburetor including a fuel bowl; and a priming system, comprising:

a control valve in fluid communication with said crankcase and said fuel bowl, said control valve movable responsive to cranking and running speeds of the engine, said control valve positioned in a first position at engine cranking speeds in which said control valve directs a substantial portion of the pressure pulses to said fuel bowl, and positioned in a second position at engine running speeds in which said control valve diverts a substantial portion of the pressure pulses away from said fuel bowl; and a vent valve in fluid communication with said control valve and said fuel bowl, said vent valve movable between a closed position at cold engine temperatures and an open position at warm engine temperatures, whereby in said closed position, a substantial portion of the pressure pulses pass from said control valve to said fuel bowl and in said open position, a substantial portion of the pressure pulses are vented to the atmosphere.

19. The internal combustion engine of claim 18, further comprising a flywheel drivably coupled to said crankshaft and disposed externally of said crankcase.

20. The internal combustion engine of claim 19, wherein said control valve comprises an air vane movable responsive to rotation of said flywheel, said air vane positioning said control valve at engine cranking and running speeds.

21. The internal combustion engine of claim 18, wherein said vent valve comprises a temperature-responsive bimetallic element.

22. The internal combustion engine of claim 18, wherein said crankcase further comprises a one-way breather valve venting only positive pressure pulses from said crankcase.

23. The internal combustion engine of claim 18, wherein said carburetor further comprises a fuel/air passage, said valve positioned at engine running speeds to divert a substantial portion of the pressure pulses to said fuel/air passage.

24. The internal combustion engine of claim 18, wherein said carburetor further comprises a primer valve in fluid communication with said control valve and with said carburetor internal chamber and movable responsive to the pressure pulses, said primer valve positioned at engine cranking speeds to allow the pressure pulses to enter said carburetor internal chamber and positioned at engine running speeds to substantially block entry of the pressure pulses into said carburetor internal chamber.

25. The internal combustion engine of claim 24, wherein said carburetor further comprises an internal vent, said primer valve positioned at engine cranking speeds to substantially block said internal vent and positioned at engine running speeds to open said internal vent.

26. An internal combustion engine, comprising:

a crankcase;

a crankshaft, connecting rod, and piston assembly disposed within said crankcase, said piston reciprocable to generate pressure pulses within said crankcase at cranking and running speeds of said engine;

a carburetor including a fuel bowl; and a priming system, comprising:

engine-responsive means for directing a substantial portion of the pressure pulses to said fuel bowl at engine cranking speeds and for diverting a substantial portion of the pressure pulses away from said fuel bowl at engine running speeds; and temperature-responsive means for substantially disabling said priming system at warm engine temperatures.

27. A method of operating an internal combustion engine, comprising the steps of:

starting the engine by cranking a crankshaft, connecting rod, and piston assembly to thereby generate pressure pulses within a crankcase of the engine;

priming a carburetor of the engine by directing at least a portion of the pressure pulses to an internal chamber of the carburetor;

automatically diverting at least a portion of the pressure pulses away from the internal chamber of the carburetor after the engine is started; and substantially disabling priming of the carburetor during subsequent re-starts of the engine.

28. The method of claim 27, wherein said internal chamber of said carburetor is a fuel bowl containing liquid fuel and an air space above the liquid fuel.

29. The method of claim 28, wherein said automatically diverting step further comprises actuating a control valve responsive to rotation of a flywheel of the engine to divert at least a portion of the pressure pulses away from the fuel bowl of the carburetor.

30. The method of claim 28, further comprising an air vane disposed proximate the flywheel and operably coupled to the control valve, the air vane and control valve movable between a first position corresponding to cranking of the engine in which the control valve directs the pressure pulses to the fuel bowl of the carburetor and a second position corresponding to running of the engine in which the control valve diverts the pressure pulses away from the fuel bowl of the carburetor.

31. The method of claim 27, wherein said automatically diverting step further comprises diverting at least a portion of the pressure pulses to an intake system of the engine.

32. The method of claim 27, wherein said substantially disabling step further comprises opening a vent valve, the vent valve in fluid communication with the carburetor and with the atmosphere.

33. The method of claim 32, wherein said vent valve comprises a temperature-responsive bimetallic element movable between a closed position corresponding to cold engine temperatures and an open position corresponding to warn engine temperatures.

34. The method of claim 27, wherein said priming step further comprises substantially blocking an internal vent structure within the carburetor.

35. The method of claim 27, wherein said automatically diverting step further comprises opening an internal vent structure within the carburetor.

* * * * *